US011239561B2

(12) United States Patent
Zhinong et al.

(10) Patent No.: US 11,239,561 B2
(45) Date of Patent: Feb. 1, 2022

(54) PATCH ANTENNA FOR MILLIMETER WAVE COMMUNICATIONS

(71) Applicant: Sony Corporation, Tokyo (JP)

(72) Inventors: Ying Zhinong, Lund (SE); Bo Xu, Lund (SE)

(73) Assignee: Sony Group Corporation, Tokyo (JP)

( * ) Notice: Subject to any disclaimer, the term of this patent is extended or adjusted under 35 U.S.C. 154(b) by 0 days.

(21) Appl. No.: 16/496,273

(22) PCT Filed: May 15, 2017

(86) PCT No.: PCT/US2017/032641
§ 371 (c)(1),
(2) Date: Sep. 20, 2019

(87) PCT Pub. No.: WO2018/212750
PCT Pub. Date: Nov. 22, 2018

(65) Prior Publication Data
US 2020/0067193 A1 Feb. 27, 2020

(51) Int. Cl.
*H01Q 9/04* (2006.01)
*H01Q 5/50* (2015.01)
(Continued)

(52) U.S. Cl.
CPC ..... *H01Q 9/0414* (2013.01); *H01Q 5/378* (2015.01); *H01Q 5/50* (2015.01); *H01Q 9/0457* (2013.01); *H01Q 9/065* (2013.01); *H01Q 21/065* (2013.01)

(58) Field of Classification Search
CPC ..... H01Q 9/0414; H01Q 5/50; H01Q 9/0457; H01Q 9/065; H01Q 21/065
(Continued)

(56) References Cited

U.S. PATENT DOCUMENTS 4,771,291 A * 9/1988 Lo ..... H01Q 9/0442 343/700 MS
6,191,740 B1 * 2/2001 Kates ..... H01Q 1/38 343/700 MS
(Continued)

FOREIGN PATENT DOCUMENTS

CN 101141023 B 12/2011
IN 1229/KOL/2015 * 3/2016 ..... H02J 17/00
(Continued)

OTHER PUBLICATIONS

Bhutani, A.; Gulan, H.; Goettel, B.; Heine, Christoph.; Thelemann, Torsten.; Pauli, M.; Zwick, T. (Apr. 2016). "122 GHZ aperture-coupled stacked patched microstrip antenna in LTCC technology." 10th European Conference on Antennas and Propagation (EUCAP). 1-5. DOI: 10.1109/EUCAP.2016.7481147 (Year: 2016).*
(Continued)

*Primary Examiner* — Ab Salam Alkassim, Jr.
(74) *Attorney, Agent, or Firm* — Tucker Ellis LLP

(57) ABSTRACT

An antenna has at least one resonant frequency within a millimeter wave frequency range. The antenna includes a ground plane disposed in a first plane, the ground plane having a first aperture at which the antenna is fed with an RF signal by a feed line; and a main patch disposed in a second plane parallel to the first plane, the first and second planes spaced apart to form a first cavity between the ground plane and the main patch, the main patch having a second aperture.

18 Claims, 9 Drawing Sheets

(51) Int. Cl.
*H01Q 9/06* (2006.01)
*H01Q 21/06* (2006.01)
*H01Q 5/378* (2015.01)

(58) Field of Classification Search
USPC ..... 343/700
See application file for complete search history.

(56) References Cited

U.S. PATENT DOCUMENTS 7,151,491 B2 * 12/2006 Jacquinot ..... H01Q 9/0407 343/700 MS
7,427,949 B2 * 9/2008 Channabasappa ..... H01Q 1/521 342/1
8,373,610 B2 * 2/2013 Chiang ..... H01Q 21/30 343/770
8,766,867 B2 * 7/2014 Ying ..... H01Q 1/521 343/833
140,354 A1 * 5/2019 Astakhov ..... H01Q 9/04
288,382 A1 * 9/2019 Kamgaing ..... H01Q 1/38
2004/0027285 A1 2/2004 Fang
2004/0189527 A1 * 9/2004 Killen ..... H01Q 9/0414 343/700 MS
2005/0195110 A1 * 9/2005 Lin ..... H01Q 9/0414 343/700 MS
2006/0044188 A1 * 3/2006 Tsai ..... H01L 23/66 343/700 MS
2007/0126638 A1 * 6/2007 Channabasappa ... H01Q 9/0442 343/700 MS
2010/0073238 A1 3/2010 Jun et al.
2012/0038529 A1 * 2/2012 Yoo ..... H01Q 9/0421 343/767
2013/0002491 A1 * 1/2013 Sabielny ..... H01Q 9/0414 343/700 MS
2013/0314283 A1 * 11/2013 Hong ..... H01Q 9/0457 343/700 MS
2015/0303576 A1 * 10/2015 Latrach ..... H01Q 9/0407 343/700 MS
2016/0079676 A1 * 3/2016 Chuang ..... H01Q 13/106 343/770
2016/0301129 A1 * 10/2016 Ying ..... H01Q 5/10
2018/0040942 A1 * 2/2018 Lepe ..... H01Q 1/2266
2018/0337456 A1 * 11/2018 Liu ..... H01Q 1/2283
2019/0020110 A1 * 1/2019 Paulotto ..... H01Q 19/005
2019/0288382 A1 * 9/2019 Kamgaing ..... H01Q 9/0407
2020/0106192 A1 * 4/2020 Avser ..... H01Q 1/38
2020/0313282 A1 * 10/2020 Jia ..... H01Q 21/08
2020/0313299 A1 * 10/2020 Jia ..... H01Q 5/307

FOREIGN PATENT DOCUMENTS

JP H04122105 A 4/1992
JP H0555820 A 3/1993
JP 2000077929 A 3/2000
JP 2007088883 A 4/2007
JP 2012182791 A 9/2012
JP 2013201711 A 3/2013
WO 2009128866 A1 10/2009
WO WO128866 A1 * 10/2009 ..... G08B 13/14
WO WO063497 * 5/2018 ..... H01Q 1/38

OTHER PUBLICATIONS

Ramli, N.; Ali, M.T., Yusof A.L.; Pasya, I.; Alias, H., Sulaiman M. A.; (Sep. 2012). "A frequency reconfigurable stacked patch microstrip antenna (FRSPMA) with aperture coupler technique." 2012 IEEE Symposium on Wireless Technology and Applications (ISWTA). 266-271 (Year: 2012).*
Akanksha Bhutani et al.: "122 GHz Aperture-Coupled Stacked Patch Microstrip Antenna in LTCC Technology", Micro-Hybrid Electronic GmbH; Ilmenau, Germany; Retrieved on May 21, 2020.
International Search Report and Written Opinion for corresponding international application No. PCT/US2017/032641, dated Feb. 6, 2018, 15 pages.
G. Amendola et al, "Annular ring slot radiating element for integrated millimeter wave arrays", 2012 6th European Conference on Antennas and Propagation (EUCAP), Mar. 26, 2012 (Mar. 26, 2012), pp. 3082-3085.
Bhutani et al, "122 GHz aperture-coupled stacked patch microstrip antenna in LTCC technology", 2016 10th European Conference on Antennas and Propagation (EUCAP), European Association of Antennas and Propagation, Apr. 10, 2016 (Apr. 10, 2016), pp. 1-5.
Ramirez M et al., "Dual-band annular-ring microstrip antenna with bow tie shaped aperture coupling", Antennas and Propagation (EUCAP), Proceedings of the 5th European Conference on, IEEE, Apr. 11, 2011 (Apr. 11, 2011), pp. 768-770.
G. Amendola et al.: "Annular Ring Slot Radiating Element for Integrated Millimeter Wave Arrays", 6th European Conference On Antennas and Propagation (EUCAP); 4 pages, copyright 2011.
Chinese Office Action from corresponding Chinese Application No. 201780090420.5, dated Jan. 26, 2021, 8 pages.

* cited by examiner

PATCH ANTENNA FOR MILLIMETER WAVE COMMUNICATIONS

TECHNICAL FIELD OF THE INVENTION

The technology of the present disclosure relates generally to antennas for electronic devices and, more particularly, to an antenna that supports millimeter wave frequencies.

BACKGROUND

Communications standards such as 3G and 4G are currently in wide-spread use. It is expected that infrastructure to support 5G communications will soon be deployed. In order to take advantage of 5G, portable electronic devices such as mobile telephones will need to be configured with the appropriate communications components. These components include an antenna that has one or more resonant frequencies in the millimeter (mm) wave range, which extends from 10 GHz to 100 GHz. In many countries, it is thought that available 5G mmWave frequencies are at 28 GHz and 39 GHz. This spectrum is not continuous in frequency. Therefore, if a mobile device were to support operation at more than one mmWave frequency, the antenna would need to be a multiple band antenna (sometimes referred to as a multiband antenna or a multimode antenna).

Also, since the wavelength is very small, performance may be enhanced by using multiple antennas in an array. An array antenna, under the correct phasing, offers potential antenna gain but also adds a challenge. The phasing narrows the antenna radiation into a beam that may be directed toward the base station. The antenna elements of the array should have a broad pattern, good polarization, low coupling and low ground currents. For dual band antennas at the proposed 28 GHz and 39 GHz frequencies, achieving these characteristics is a challenge. One reason for this is that a narrow band feedline typically has undesired radiation at the resonant mmWave frequency.

SUMMARY

This disclosure describes a slot-coupled patch antenna that has bandwidth characteristics to support wireless communications over one or more 5G mmWave operating frequencies. The antenna substantially removes feeding line emissions and suppresses mutual coupling when implemented in an array. The antenna has a multilayer structure with a patch and slot arrangement. The antenna may have compact size and good bandwidth at a first resonance frequency, such as around 28 GHz. Another resonance frequency, such as around 39 GHz, may be established by adding a parasitic patch. Multiple antennas may be arranged in an array. The antenna (or an array of the antennas) may be used in, for example, a mobile terminal (e.g., mobile phone), a small base station, or an Internet of Things (IoT) device.

According to aspects of the disclosure, a patch antenna has at least one resonant frequency within a millimeter wave frequency range, and includes: a ground plane disposed in a first plane, the ground plane having a first aperture at which the antenna is fed with an RF signal by a feed line; and a main patch disposed in a second plane parallel to the first plane, the first and second planes spaced apart to form a first antenna cavity between the ground plane and the main patch, the main patch having a second aperture.

According to an embodiment of the antenna, the first antenna cavity is an air gap.

According to an embodiment of the antenna, geometric centers of the apertures are coaxially aligned.

According to an embodiment of the antenna, the ground plane is disposed on a first substrate and the main patch is disposed on a second substrate.

According to an embodiment of the antenna, the first and second substrates are layers of a multilayer printed circuit board.

According to an embodiment of the antenna, the cavity is formed by removing a portion of the multilayer printed circuit board.

According to an embodiment of the antenna, the antenna further includes a parasitic patch disposed in a third plane parallel to the first and second planes, the third plane spaced apart from the second plane to form a second antenna cavity between the main patch and the parasitic patch on a side of the main patch opposite the first antenna cavity, the parasitic patch adding a second resonant frequency within the millimeter wave frequency range to the antenna.

According to an embodiment of the antenna, a first resonant frequency of the antenna is at about 28 GHz and the second resonant frequency is at about 39 GHz.

According to an embodiment of the antenna, the geometric centers of the main patch and the parasitic patch are coaxially aligned.

According to an embodiment of the antenna, the geometric centers of the main patch, the parasitic patch and the apertures are coaxially aligned.

According to an embodiment of the antenna, the apertures have lengths of about 2.7 mm; a height of the first antenna cavity is about 0.3 mm; a height of the second antenna cavity is about 0.1 mm; a length of the main patch is about 3.4 mm to about 3.6 mm; a width of the main patch is about 3.4 mm to about 3.6 mm; a length of the parasitic patch is about 0.6 mm to about 0.9 mm; and a width of the main patch is about 0.7 mm to about 1.0 mm.

According to other aspects of the disclosure, an electronic device includes the antenna and communication circuitry operatively coupled to the antenna, wherein the communication circuitry is configured to generate the radio frequency signal that is feed to the antenna for emission as part of wireless communication with another device.

The proposed multi-layer configuration suppresses surface waves that have been observed in the chassis (housing) of user devices when operating in mmWave bands, yet provides enough bandwidth for wireless communication. The proposed antenna configuration is compact and can be easily integrated into user equipment that operates in mmWave bands. In embodiments where the parasitic patch is present and fed through the aperture on the main patch, a higher resonant frequency is excited so that the patch antenna provides dual band radiation without increasing the antenna's footprint.

DETAILED DESCRIPTION OF EMBODIMENTS

Figure 1:
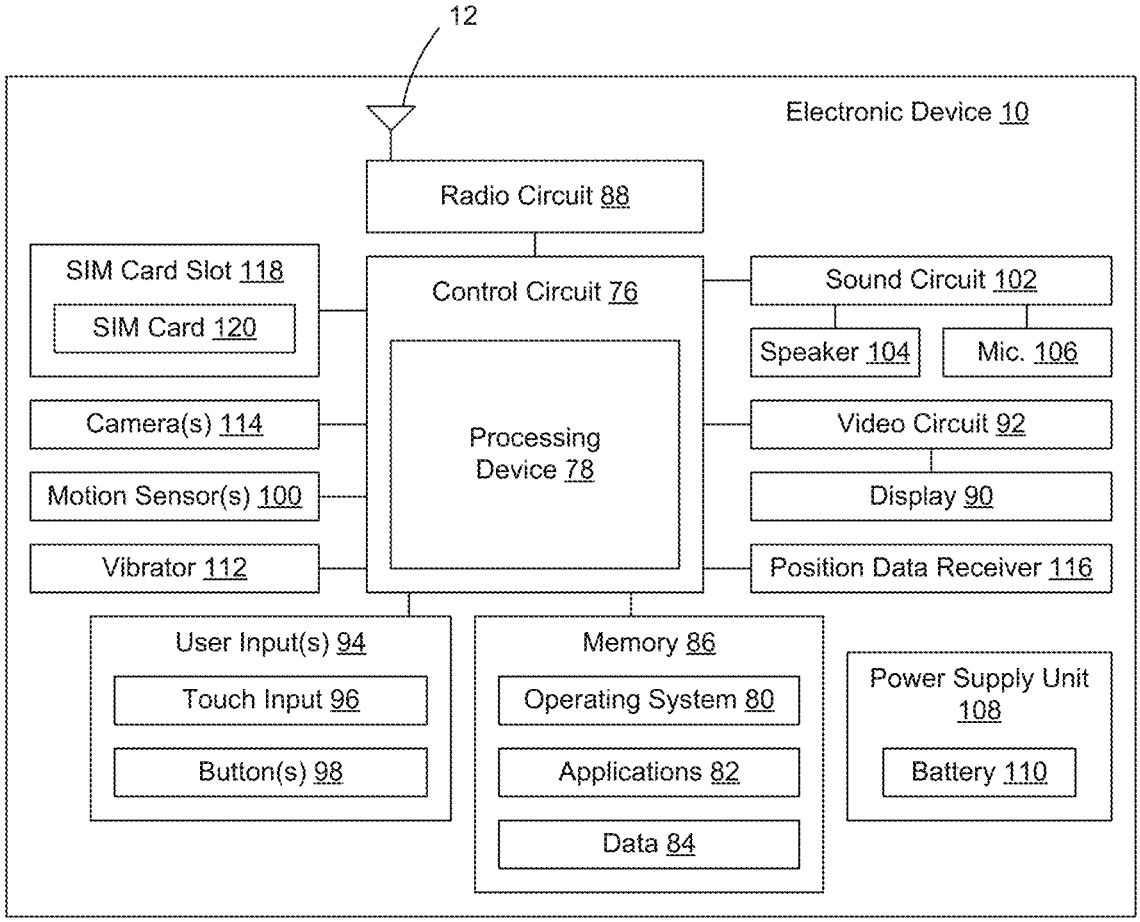
FIG. 1 is a schematic diagram of an electronic device that includes an antenna according to the disclosure.

Embodiments will now be described with reference to the drawings, wherein like reference numerals are used to refer to like elements throughout. It will be understood that the figures are not necessarily to scale. Features that are described and/or illustrated with respect to one embodiment may be used in the same way or in a similar way in one or more other embodiments and/or in combination with or instead of the features of the other embodiments.

Described below, in conjunction with the appended figures, are various embodiments of antenna structures that may be used at mmWave frequencies. Although the figures illustrate one antenna, it will be understood that an array of the antennas may be used for a beam shaping or sweeping application.

Multi-Mode Antenna Structure

Referring to FIG. 1, illustrated is an exemplary environment for the disclosed antenna. The exemplary environment is an electronic device 10 configured as a mobile radiotelephone, more commonly referred to as a mobile phone or a smart phone. The electronic device 10 may be referred to as a user equipment or UE. The electronic device 10 may be, but is not limited to, a mobile radiotelephone, a tablet computing device, a computer, a gaming device, an Internet of Things (IoT) device, a media player, a base station or access point, etc. Additional details of the exemplary electronic device 10 are described below.

Figure 2:
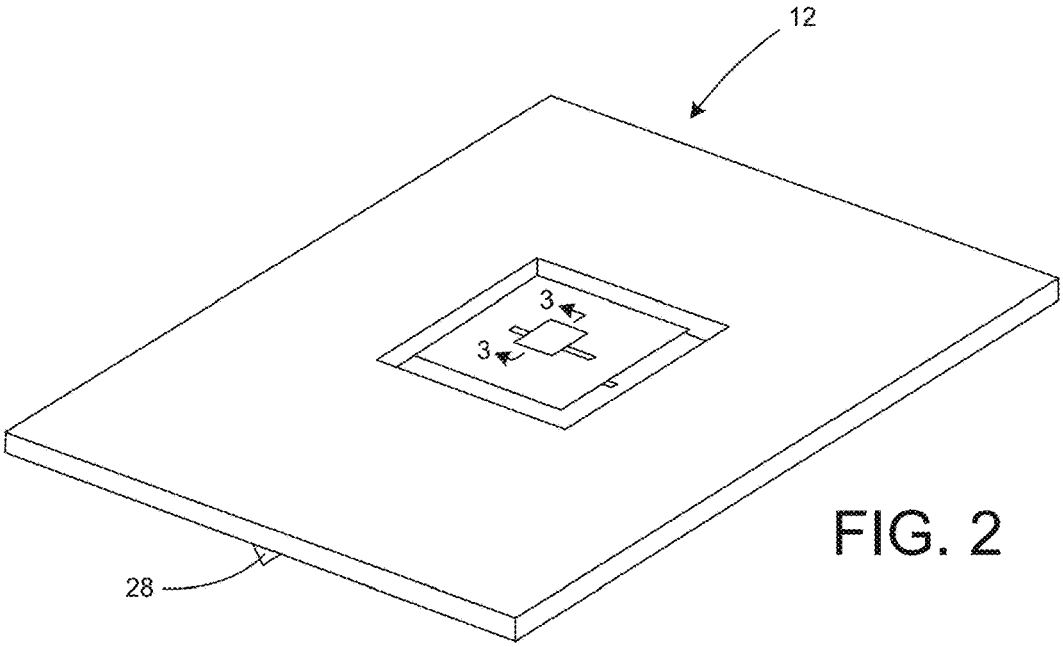
FIG. 2 is a representation of an antenna according to the disclosure.
Figure 3:
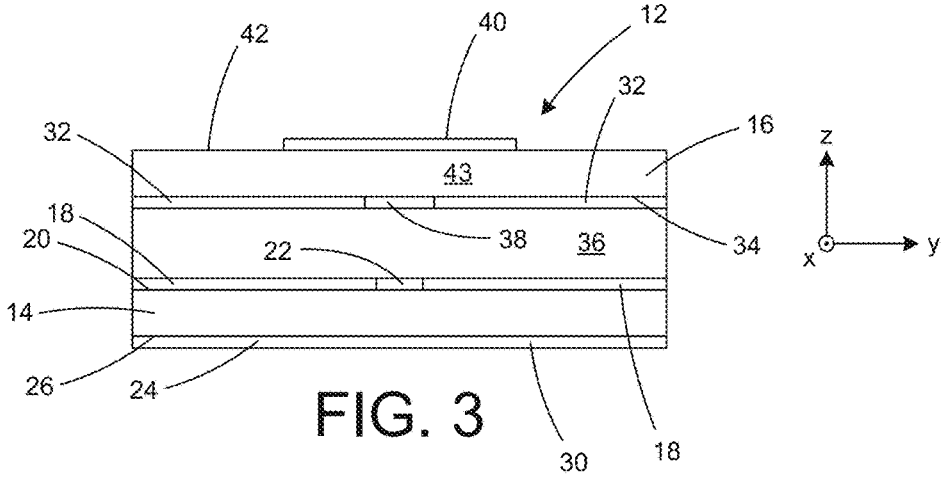
FIG. 3 is a cross-section of the antenna taken along the line 3-3 of FIG. 2.
Figure 4A:
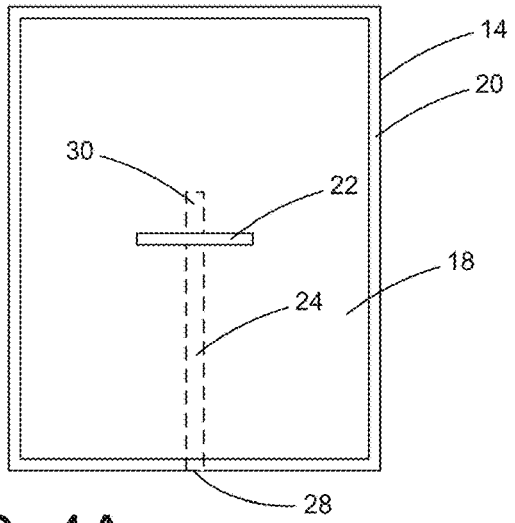
FIG. 4A is a top view of a first substrate for the antenna.
Figure 4B:
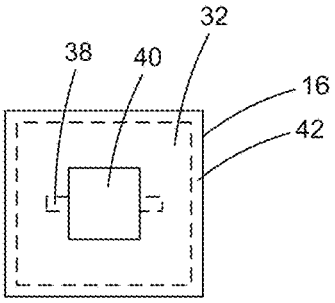
FIG. 4B is a top view of a second substrate for the antenna.

As indicated, the electronic device 10 includes an antenna 12 to support wireless communications. With additional reference to FIG. 2, an embodiment of the antenna 12 is illustrated in somewhat schematic form. FIG. 3 illustrates a cross-section of the antenna 12 along the line 3-3 in FIG. 2 and shows all operative structural features of the indicated portion of the antenna 12. FIG. 2 includes a coordinate system for reference. The directional descriptions in this disclosure are made relative to the coordinate system and are not related to any orientation of the antenna 12 in space. FIGS. 4A and 4B respectively are a top view of a first substrate 14 of the antenna 12 and a second substrate 16 of the antenna. In FIGS. 4A and 4B, conductive layers on the top of the substrates 14, 16 are illustrated in solid lines and conductive layers on the bottom of the substrates 14, 16 are illustrated in broken lines. The substrates 14, 16 may be, for example, individual printed circuit boards (PCBs) or may be layers of a multilayer PCB.

With reference to FIGS. 2 through 4B, the antenna 12 is aperture-fed (e.g., the line feeding RF energy to the antenna is shielded from the rest of the antenna by a conducting plane having an aperture to transmit energy to the radiating portions of the antenna). For this purpose, the antenna 12 includes a ground plane 18 disposed on an upper surface 20 of the first substrate 14. A first aperture 22 (also referred to as a slot) is formed in the ground plane 18 and has a longitudinal axis in the direction of the x-axis. A feedline 24 is disposed on a lower surface 26 of the first substrate 14. The feedline 24 may be, for example, a 50 ohm (Ω) open-ended microstrip line that has a longitudinal axis in the direction of the y axis. The feedline 24 extends from a connection point 28 (schematically represented by a triangular shaped item in FIG. 2) to an end of a stub 30. The stub 30 (or portion of the feedline 24 that extends in the direction of the y-axis past the aperture 22) has an electrical length of a quarter wavelength. The feedline 24 connects to a component that supplies an RF signal at the connection point 28. The component that supplies the RF signal may be an output of a power amplifier or an output of a tuning or impedance matching circuit. The component that supplies the RF signal may be located on another layer of the PCB that includes the first substrate 14 or on a separate substrate.

A main patch 32 is disposed on a lower surface 34 of the second substrate 16. The second substrate 16 is positioned relative to first substrate 14 so that the ground plane 18 and the main patch 32 are spaced apart from one another in the direction of the z-axis. Exemplary spacing between the ground plane 18 and the main patch 32, as well as other antenna parameters, are provided in the following section. As a result, an antenna cavity 36 is present between the main patch 32 and the ground plane 18. In a preferred embodiment, the antenna cavity 36 is filled with air and may be referred to as an air gap. In another embodiment, the antenna cavity 36 is filled with a dielectric material other than air.

In one embodiment in which the first and second substrates 14, 16 are part of a multilayer PCB, the antenna cavity 36 is also a physical cavity in the multilayer PCB formed by removing part of the multilayer PCB. For instance, a portion of a third substrate (not shown) that is interposed between the first and second substrates 14, 16 may be removed by a process such as drilling, machining or etching. In this case, remaining portions of the third substrate provide mechanical support to the second substrate 16. In another embodiment in which the second substrate 16 is a separate component from the first substrate 14, the second substrate 16 may be maintained in a position relative to the first substrate using spacers or other retaining members.

A second aperture 38 (also referred to as a slot) is formed in the main patch 32 and has a longitudinal axis in the direction of the x-axis. Therefore, the first aperture 22 and the second aperture 38 are parallel to one another. In one embodiment, a geometric center of the first aperture 22 is aligned above (in the direction of the z-axis) a geometric center of the second aperture 38. Thus, the apertures 22, 38 have a common central axis and may be considered to be coaxially aligned in the direction of the z-axis (e.g., the geometric centers of the apertures 22, 38 have the same x-axis and y-axis values, but different z-axis values). This relationship provides higher radiation efficiency of the antenna 12. The intersection of the first aperture 22 and the feed line 24 in the direction of the z-axis also may be coaxially aligned with the geometric centers of the apertures 22, 28.

The second aperture 38 enlarges an electrical length of the surface current of the main patch 32 versus the electrical length of the surface current of a similar main patch without the aperture 38. The electrical length of the surface current of the main patch 32 increases with increases in physical length of the second aperture 38 (length being measured in the direction of the x-axis). As a result, the resonant frequency and bandwidth of the antenna 12 decrease with increases in physical length of the second aperture 38. The width of each aperture 22, 38 is small compared to its respective length since width of the apertures 22, 38 has little influence on the resonant frequency (width being measured in the direction of the y-axis). In one embodiment, the width of the second aperture 38 is about one tenth its length, but a width up to one half of its length is possible.

To add a second resonant mode for achieving dual band radiation, a parasitic patch 40 may be added to an upper surface 42 of the second substrate 16. As will be understood, the parasitic patch is an element that is not driven with an RF signal. In one embodiment, the parasitic patch is not electrically connected to any other elements of the antenna 12, but functions as a passive resonator to establish the second resonant mode. Electrically, a second antenna cavity 43 exists between the main patch 32 and the parasitic patch 40. The second cavity may be filled with the material of the second substrate 16, a different dielectric material, or air. One or more additional parasitic patches may be added vertically above the parasitic patch to add additional corresponding resonant modes.

The feed line 24, ground plane 18, main patch 32 and parasitic patch 40 may be made from appropriate conductive material or materials, such as copper. In one embodiment, the feed line 24, ground plane 18, main patch 32 and parasitic patch 40 each are in a respective plane that are parallel to one another. In one embodiment, a geometric center of the main patch 32 and the geometric center of the parasitic patch 40 are aligned above one another (in the direction of the z-axis) so that the patches 32, 40 have a common central axis. The coaxial alignment of the patches 32 may be in common coaxial alignment with the geometric centers of the apertures 22, 38.

Example

Figure 5:
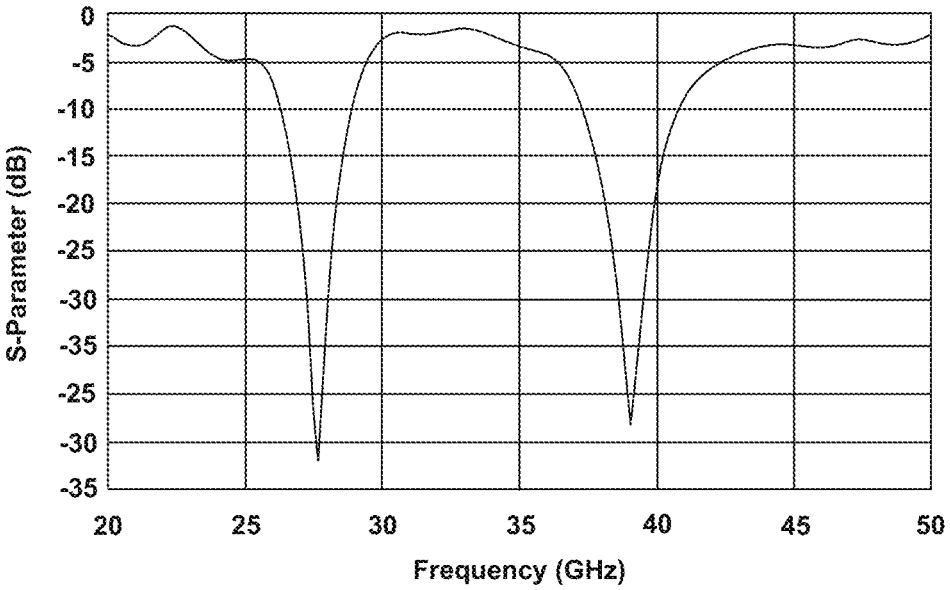
FIG. 5 is a plot of operating characteristics of the antenna.

In an exemplary embodiment, the antenna 12 may be configured to have resonant frequencies at 28 GHz and 39 GHz. This is reflected in the plot of S(1,1)-parameters over frequency for the antenna 12 shown in FIG. 5.

To achieve these characteristics, the length of the apertures 22, 38 may be about 2.7 millimeters (mm), the width of the apertures 22, 38 may be in the range of about 0.1 mm to about 0.3 mm, the height of the antenna cavity 36 (e.g., the spacing between the main patch 32 and the ground plane 18) may be about 0.3 mm (height measured in the direction of the z-axis), the height of the substrates 14, 16 may be about 0.1 mm, the substrates 14, 16 may have a permittivity of 3.38, a length of the main patch 32 may be in the range of about 3.4 mm to about 3.6 mm, a width of the main patch 32 may be in the range of about 3.4 mm to about 3.6 mm, a length of the parasitic patch 40 may be in the range of about 0.6 mm to about 0.9 mm, and a width of the parasitic patch 40 may be in the range of about 0.7 mm to about 1.0 mm. Since the second substrate 16 spaces apart the main patch 32 and the parasitic patch 40, the height of the second cavity 43 may be same as the height of the second substrate 16. In one embodiment, the substrates 14, 16 are made from dielectric material RO4003 available from Rogers Corporation of Chandler, Ariz., United States.

The foregoing parameters may be adjusted to achieve desired resonant frequencies and improve impedance matching. Exemplary adjustments that may be made will be described in the parametric studies that follow.

Figure 6A:
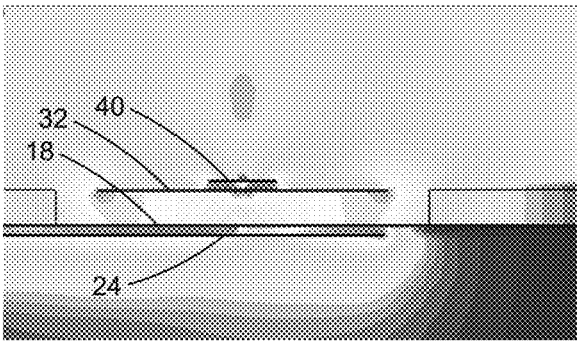
FIGS. 6A and 6B are side views of the antenna of FIG. 2 respectively showing electric fields while the antenna resonates in the first and second resonant modes.
Figure 6B:
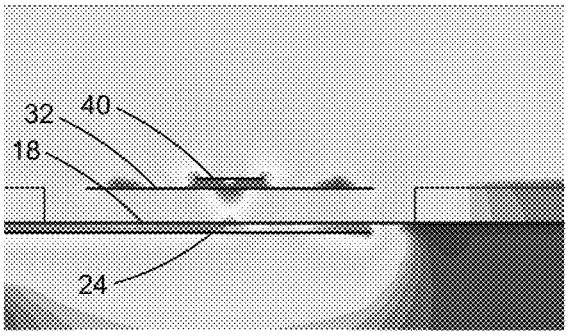
Figure 7A:
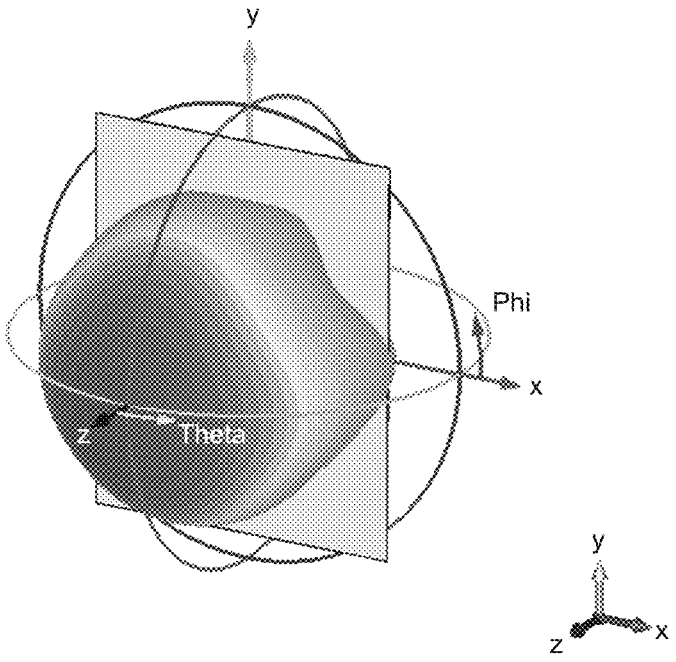
FIGS. 7A and 7B are radiation patterns of the antenna of FIG. 2 emitting respectively at the first and second resonant frequencies.
Figure 7B:
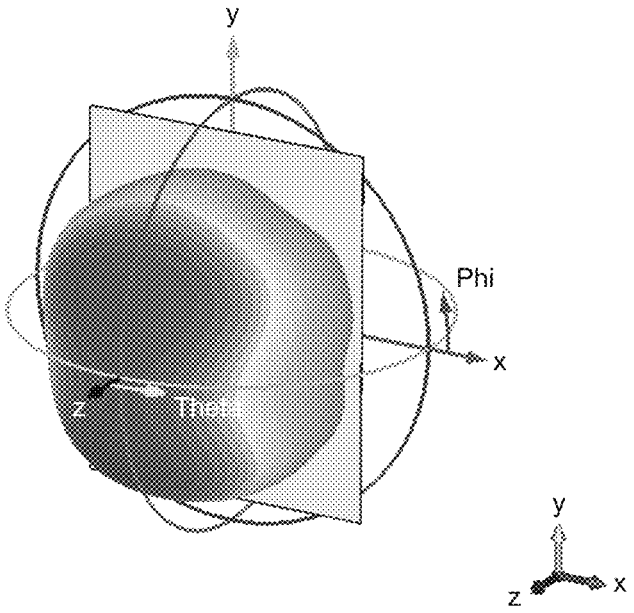

At the first (lower) resonant mode, the electric field ($E_z$) in the lower antenna cavity between the main patch 32 and the ground plane 18 (e.g., in the antenna cavity 36) is strong and the main patch 32 is the primary radiation element at the lower resonant frequency, which is at around 28 GHz in the example. At the second (upper) resonant mode, the electric field ($E_z$) in the lower antenna cavity between the main patch 32 and the ground plane 18 (e.g., in the antenna cavity 36) is weaker than in the lower resonant mode. However, the electric field ($E_z$) in the upper antenna cavity 43 between the main patch 32 and the parasitic patch 40 increases relative to the lower resonant mode, resulting in a hybrid mode where both the main patch 32 and the parasitic patch 40 radiate at the upper resonant frequency, which is at around 39 GHz in the example. FIGS. 6A and 6B are representative side views of the antenna 12 that respectively include electric fields while the antenna resonates in the lower and upper resonant modes. FIG. 7A is a radiation pattern of the antenna 12 while emitting in the lower resonant mode. FIG. 7B is a radiation pattern of the antenna 12 while emitting in the upper resonant mode. In FIGS. 7A and 7B, the y-axis extends in the vertical direction, the x-axis and the y-axis form the illustrated plane, and the z-axis extends in the normal direction from the illustrated plane.

Alternative Single-Mode Embodiment

Figure 8:
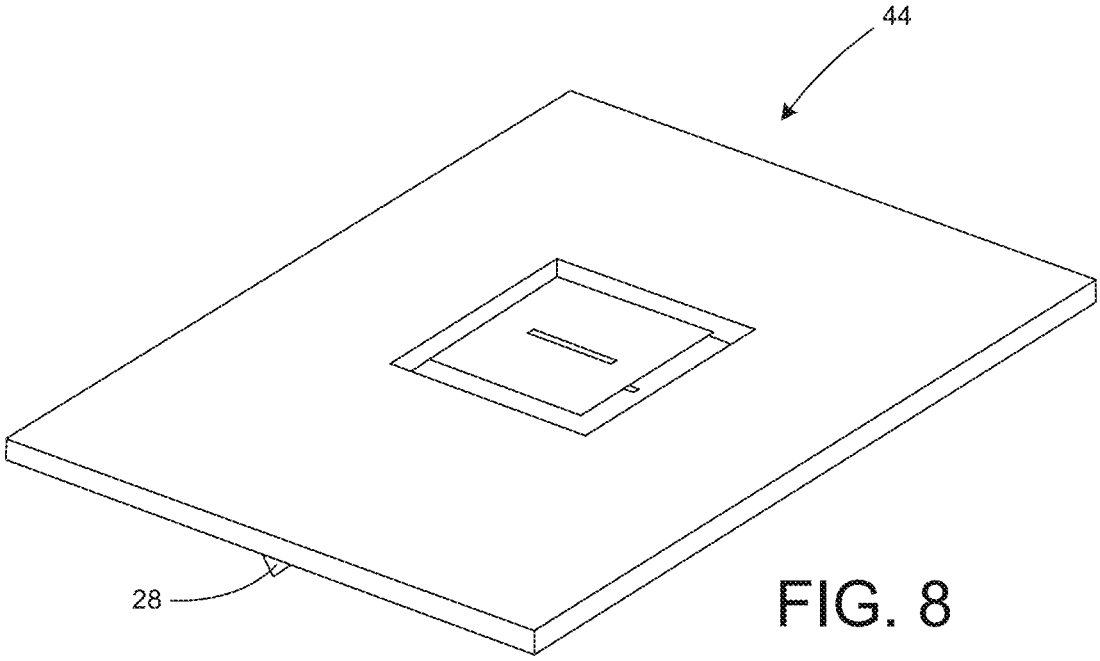
FIG. 8 is a representation of another embodiment of the antenna according to the disclosure.
Figure 9:
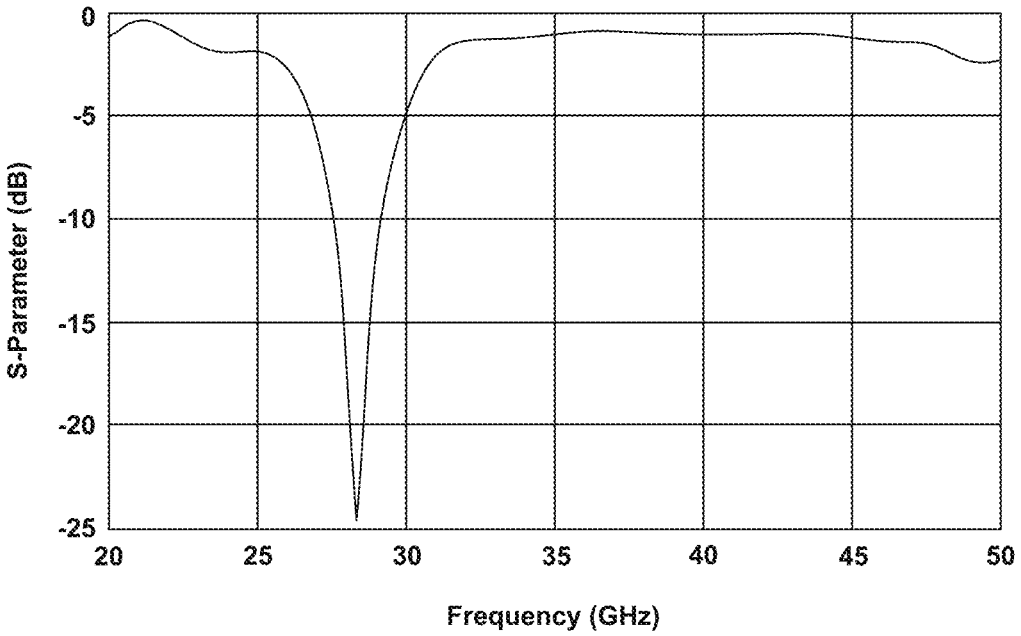
FIG. 9 is a plot of operating characteristics of the antenna of FIG. 8.

With reference to FIG. 8, an alternative embodiment of an antenna is illustrated. Similar to the illustration of FIG. 2, the illustration of FIG. 8 is in somewhat schematic form. The antenna 44 has the same configuration as antenna 12 of FIGS. 2 through 4B, but the parasitic patch 40 on the upper surface of 42 of the second substrate 16 is omitted. The second substrate 16 is not illustrated in FIG. 8, but may be present to support the main patch 32. The antenna 44 may be configured to have a single resonant mode, such as at around 28 GHz. This is reflected in the plot of S(1,1)-parameters over frequency for the antenna 44 shown in FIG. 9.

Figure 10:
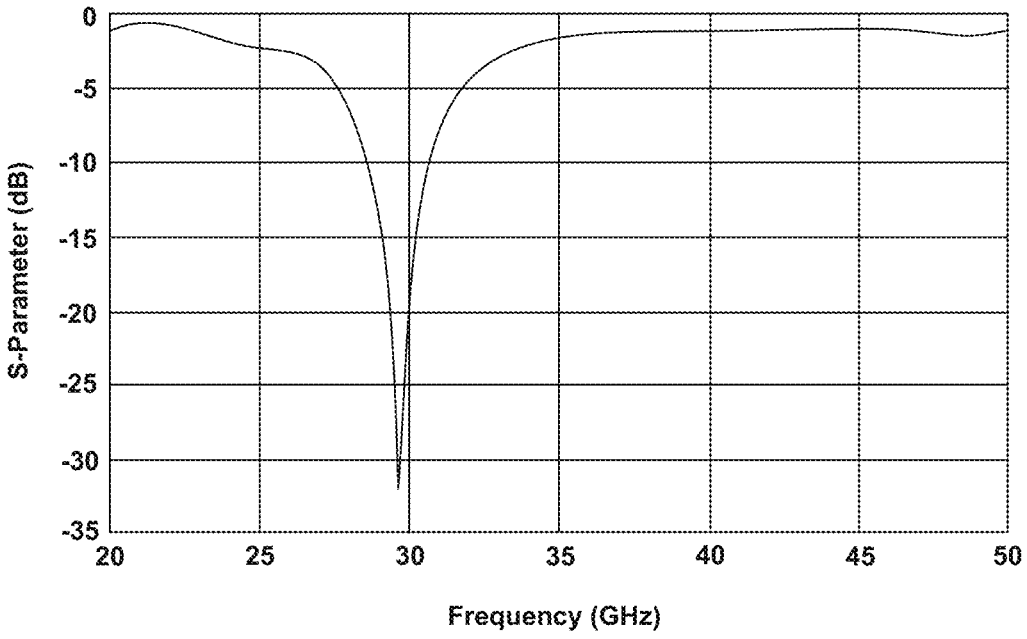
FIG. 10 is plot of operating characteristics of the antenna of FIG. 8 but without an aperture in a main patch element of the antenna.

FIG. 10 is a plot of S(1,1)-parameters over frequency for the antenna 44 but where the main patch 32 is a continuous conductive layer without the aperture 38. As can be seen, the aperture 38 lowers the resonant frequency of the antenna 44. The aperture 38 causes a similar lowering of the resonant frequency in the antenna 12, as previously mentioned.

Parametric Studies of Multi-Mode Antenna

Figure 11A:
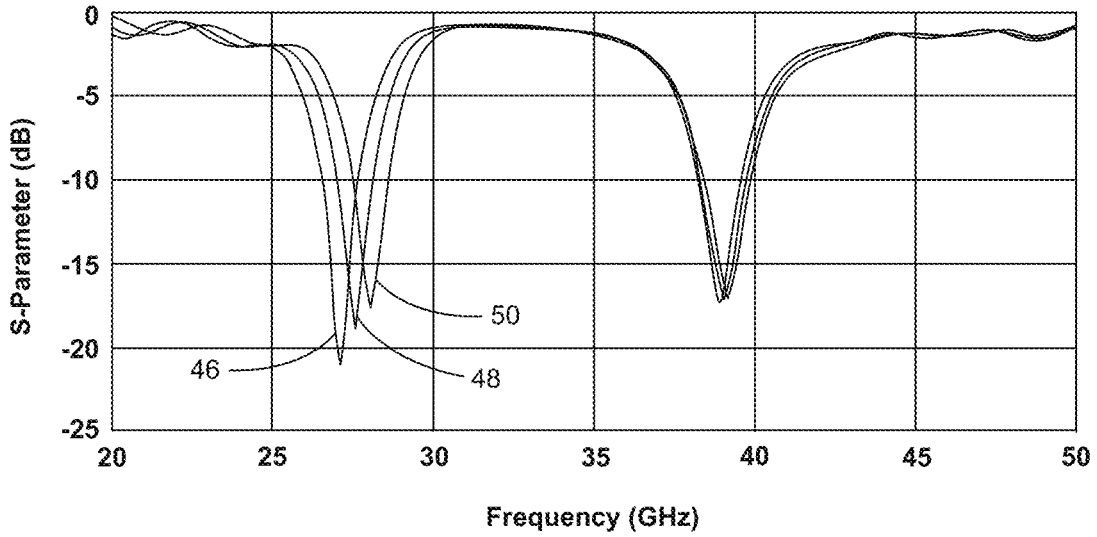
FIGS. 11A and 11B are plots of operating characteristics of the antenna of FIG. 2 showing the effect of varying characteristics of a main patch element of the antenna.

Varying the size of the main patch 32 of the antennas 12, 44 may change the electrical characteristics of the antennas 12, 44. For example, FIG. 11A shows the effect of changing the dimension of the main patch 32 of antenna 12 in the direction of the y-axis. For reference, this dimension will be referred to as the width of the main patch 32. The dimension that extends along the x-axis will be referred to as the length of the main patch 32. The length of the main patch 32 remains constant for the analysis conducted in connection with FIG. 11A. Curve 46 is a plot of S(1,1)-parameters over frequency for the antenna 12 for a width of the main patch 32 of 3.6 mm and a length of 3.5 mm. Curve 48 is a plot of S(1,1)-parameters over frequency for the antenna 12 for a width of the main patch 32 of 3.5 mm and a length of 3.5 mm. Curve 50 is a plot of S(1,1)-parameters over frequency for the antenna 12 for a width of the main patch 32 of 3.4 mm and a length of 3.5 mm. As illustrated, varying the width alters the lower resonant frequency.

Figure 11B:
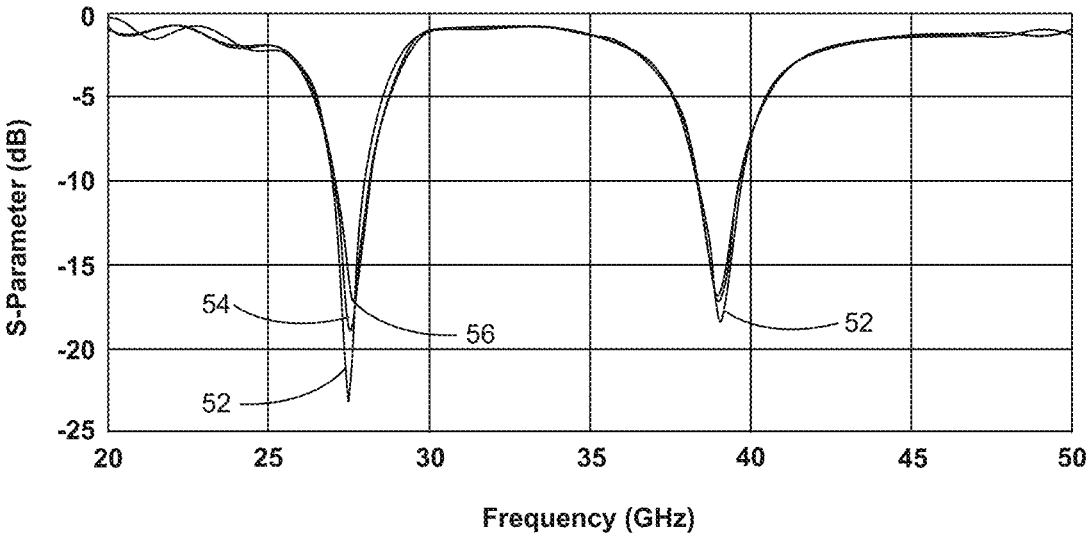

FIG. 11B shows the effect of changing the dimension of the main patch 32 of antenna 12 in the length direction while maintaining a constant width of 3.7 mm. Curve 52 is a plot of S(1,1)-parameters over frequency for the antenna 12 for a length of the main patch 32 of 3.6 mm. Curve 54 is a plot of S(1,1)-parameters over frequency for the antenna 12 for a length of the main patch 32 of 3.5 mm. Curve 56 is a plot of S(1,1)-parameters over frequency for the antenna 12 for a length of the main patch 32 of 3.4 mm. As illustrated, changing the length has only a small effect on the lower resonant frequency. These changes may be useful in fine-tuning of the lower resonant frequency. Also, change in the length of the main patch 32 may assist in impedance matching of the antenna 12.

Figure 12A:
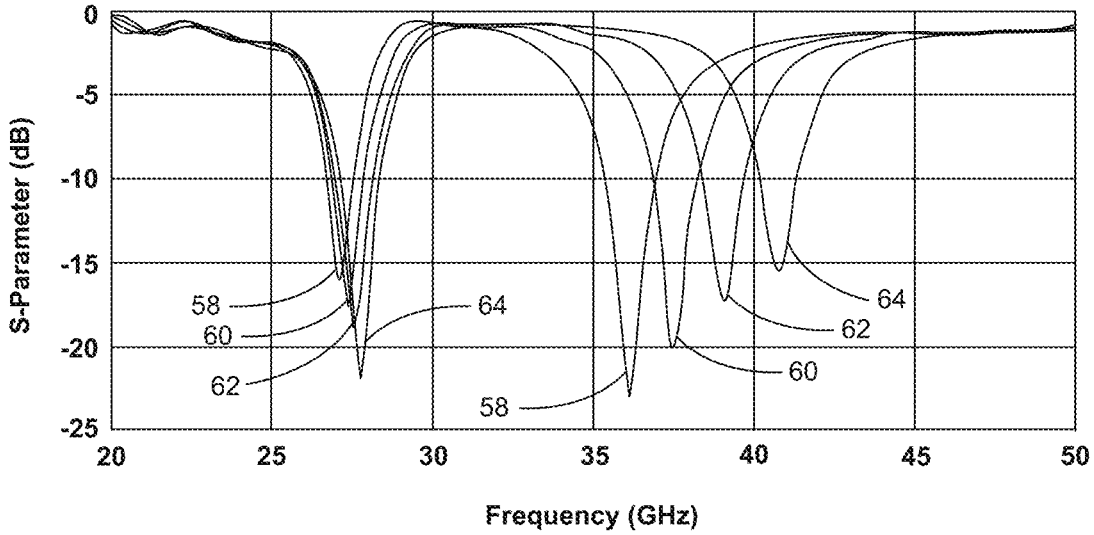
FIGS. 12A and 12B are plots of operating characteristics of the antenna of FIG. 2 showing the effect of varying characteristics of a parasitic patch element of the antenna.

Varying other dimensions of the antenna 12 may result in additional changes to electrical characteristics. For instance, the length of the aperture 38, the length of the parasitic patch 40 and the width of the parasitic patch 40 are three dimensions that have the most effect on the upper resonant frequency. For example, FIG. 12A shows the effect of changing the width of the parasitic patch while maintaining a constant length of 0.9 mm for the parasitic patch 40 and a constant length of the aperture 38 of 2.1 mm. Curve 58 is a plot of S(1,1)-parameters over frequency for the antenna 12 for a width of the parasitic patch 40 of 1.0 mm. Curve 60 is a plot of S(1,1)-parameters over frequency for the antenna 12 for a width of the parasitic patch 40 of 0.9 mm. Curve 62 is a plot of S(1,1)-parameters over frequency for the antenna 12 for a width of the parasitic patch 40 of 0.8 mm. Curve 64 is a plot of S(1,1)-parameters over frequency for the antenna 12 for a width of the parasitic patch 40 of 0.7 mm.

Figure 12B:
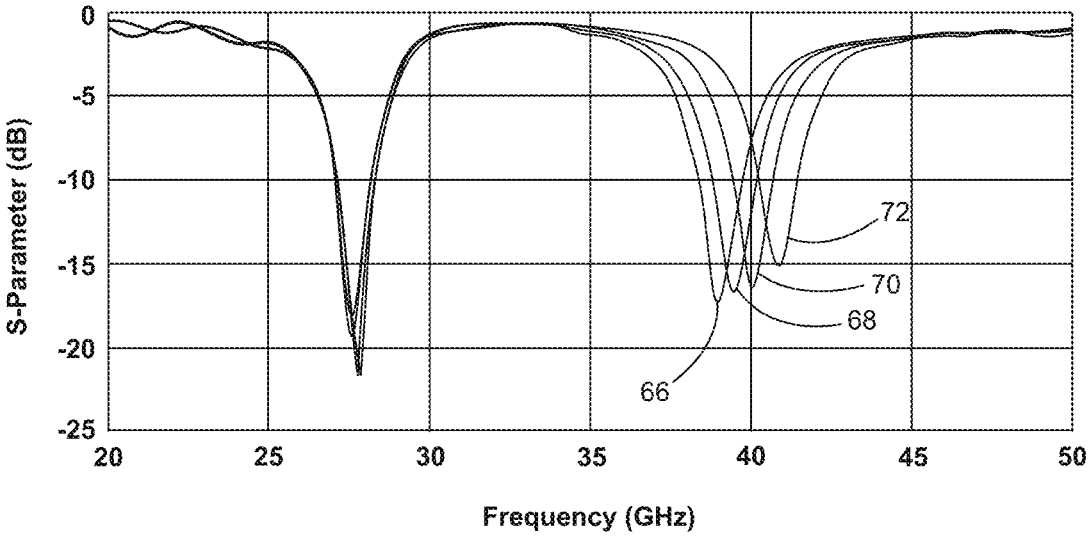

FIG. 12B shows the effect of changing the length of the parasitic patch while maintaining a constant width of 2.5 mm for the parasitic patch 40 and a constant length of the aperture 38 of 2.1 mm. Curve 66 is a plot of S(1,1)-parameters over frequency for the antenna 12 for a length of the parasitic patch 40 of 0.9 mm. Curve 68 is a plot of S(1,1)-parameters over frequency for the antenna 12 for a length of the parasitic patch 40 of 0.8 mm. Curve 62 is a plot of S(1,1)-parameters over frequency for the antenna 12 for a length of the parasitic patch 40 of 0.7 mm. Curve 64 is a plot of S(1,1)-parameters over frequency for the antenna 12 for a length of the parasitic patch 40 of 0.6 mm.

As will be appreciated, the dimensions of the main patch 32, the aperture 38 and the parasitic patch 40 may be cooperatively altered to achieve desired upper and lower resonant frequencies.

Multi-Mode Antenna Array

Figure 13:
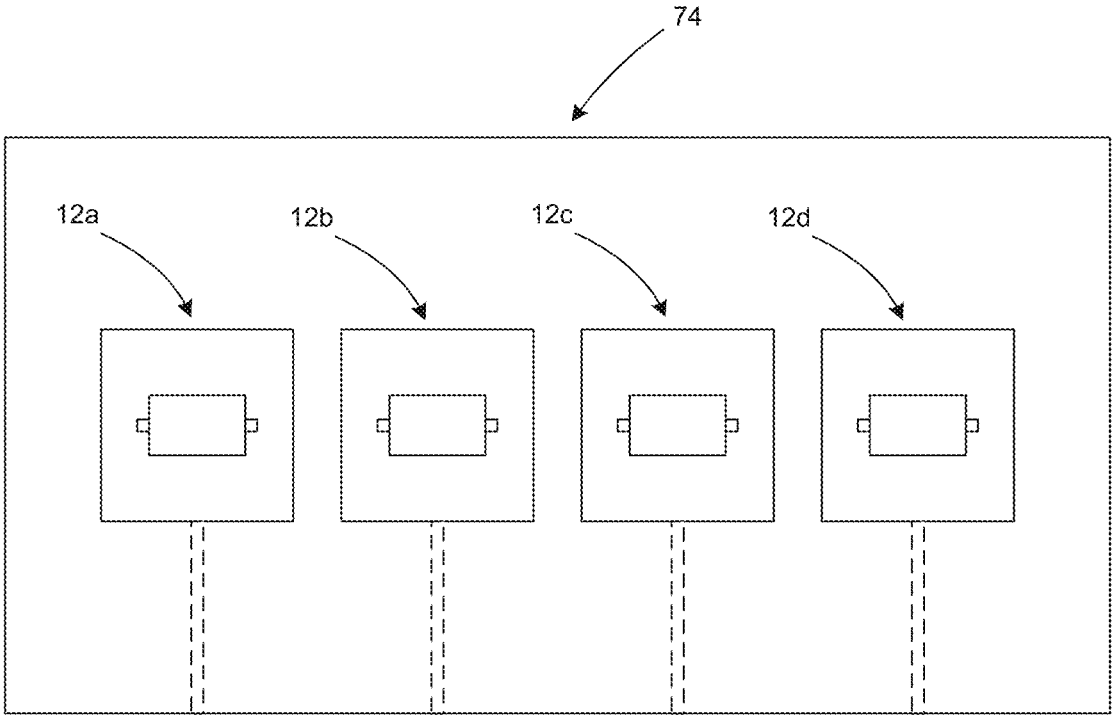
FIG. 13 illustrates an antenna array having antennas in accordance with the antenna of FIG. 2.

FIG. 13 illustrates an antenna array 74 that includes a plurality of antennas that are each made in accordance with the antenna 12 illustrated in FIGS. 2 through 4B. In another embodiment, the antenna array 74 may have a plurality of antennas that are each made in accordance with the antenna 44 illustrated in FIG. 8. In the illustrated embodiment, four antennas 12*a*-12*d* are present. The antennas 12 of the antenna array 74 may share one or more of a common first substrate 14, a common second substrate 16, a common ground plane 18, or a common physical cavity that forms the antenna cavity 36 between the respective main patches 32 and ground plane(s) 18. Each antenna 12 of the array 74 is feed with a respective RF signal. The RF signals have relative phasing to direct or steer a resultant emission pattern for beam scanning or sweeping applications.

Exemplary Operational Environment

As will be appreciated, the foregoing disclosure describes a multiband antenna structure that is configurable to support 5G communications in mmWave bands. Returning to FIG. 1, illustrated is a schematic block diagram of the electronic device 10 in an exemplary embodiment as a mobile telephone that uses the antenna 12 (or antenna 44) for radio (wireless) communications. In one embodiment, the antenna 12 supports communications with a base station of a cellular telephone network, but may be used to support other wireless communications, such as WiFi communications. Additional antennas may be present to support other types of communications such as, but not limited to, WiFi communications, Bluetooth communications, body area network (BAN) communications, near field communications (NFC), and 3G and/or 4G communications.

The electronic device 10 includes a control circuit 76 that is responsible for overall operation of the electronic device 10. The control circuit 76 includes a processor 78 that executes an operating system 80 and various applications 82. The operating system 80, the applications 82, and stored data 84 (e.g., data associated with the operating system 80, the applications 82, and user files), are stored on a memory 86. The operating system 80 and applications 82 are embodied in the form of executable logic routines (e.g., lines of code, software programs, etc.) that are stored on a non-transitory computer readable medium (e.g., the memory 86) of the electronic device 10 and are executed by the control circuit 76.

The processor 78 of the control circuit 76 may be a central processing unit (CPU), microcontroller, or microprocessor. The processor 78 executes code stored in a memory (not shown) within the control circuit 76 and/or in a separate memory, such as the memory 86, in order to carry out operation of the electronic device 10. The memory 86 may be, for example, one or more of a buffer, a flash memory, a hard drive, a removable media, a volatile memory, a non-volatile memory, a random access memory (RAM), or other suitable device. In a typical arrangement, the memory 86 includes a non-volatile memory for long term data storage and a volatile memory that functions as system memory for the control circuit 76. The memory 86 may exchange data with the control circuit 76 over a data bus. Accompanying control lines and an address bus between the memory 86 and the control circuit 76 also may be present. The memory 86 is considered a non-transitory computer readable medium.

As indicated, the electronic device 10 includes communications circuitry that enables the electronic device 10 to establish various wireless communication connections. In the exemplary embodiment, the communications circuitry includes a radio circuit 88. The radio circuit 88 includes one or more radio frequency transceivers and is operatively connected to the antenna 12 and any other antennas of the electronic device 10. In the case that the electronic device 10 is a multi-mode device capable of communicating using more than one standard or protocol, over more than one radio access technology (RAT) and/or over more than one radio frequency band, the radio circuit 88 represents one or more than one radio transceiver, tuners, impedance matching circuits, and any other components needed for the various supported frequency bands and radio access technologies. Exemplary network access technologies supported by the radio circuit 88 include cellular circuit-switched network technologies and packet-switched network technologies. The radio circuit 88 further represents any radio transceivers and antennas used for local wireless communications directly with another electronic device, such as over a Bluetooth interface and/or over a body area network (BAN) interface.

The electronic device 10 further includes a display 90 for displaying information to a user. The display 90 may be coupled to the control circuit 76 by a video circuit 92 that converts video data to a video signal used to drive the display 90. The video circuit 92 may include any appropriate buffers, decoders, video data processors, and so forth.

The electronic device 10 may include one or more user inputs 94 for receiving user input for controlling operation of the electronic device 10. Exemplary user inputs 94 include, but are not limited to, a touch sensitive input 96 that overlays or is part of the display 90 for touch screen functionality, and one or more buttons 98 Other types of data inputs may be present, such as one or more motion sensors 100 (e.g., gyro sensor(s), accelerometer(s), etc.).

The electronic device 10 may further include a sound circuit 102 for processing audio signals. Coupled to the sound circuit 102 are a speaker 104 and a microphone 106 that enable audio operations that are carried out with the electronic device 10 (e.g., conduct telephone calls, output sound, capture audio, etc.). The sound circuit 102 may include any appropriate buffers, encoders, decoders, amplifiers, and so forth.

The electronic device 10 may further include a power supply unit 108 that includes a rechargeable battery 110. The power supply unit 108 supplies operational power from the battery 110 to the various components of the electronic device 10 in the absence of a connection from the electronic device 10 to an external power source.

The electronic device 10 also may include various other components. For instance, the electronic device 10 may include one or more input/output (I/O) connectors (not shown) in the form electrical connectors for operatively connecting to another device (e.g., a computer) or an accessory via a cable, or for receiving power from an external power supply.

Another exemplary component is a vibrator 112 that is configured to vibrate the electronic device 10. Another exemplary component may be one or more cameras 114 for taking photographs or video, or for use in video telephony. As another example, a position data receiver 116, such as a global positioning system (GPS) receiver, may be present to assist in determining the location of the electronic device 10. The electronic device 10 also may include a subscriber identity module (SIM) card slot 118 in which a SIM card 120 is received. The slot 118 includes any appropriate connectors and interface hardware to establish an operative connection between the electronic device 10 and the SIM card 120.

Although certain embodiments have been shown and described, it is understood that equivalents and modifications falling within the scope of the appended claims will occur to others who are skilled in the art upon the reading and understanding of this specification.

What is claimed is:

1. A patch antenna, comprising:

a ground plane disposed in a first plane, the ground plane having a first aperture at which the patch antenna is fed with an RF signal by a feed line;

a main patch disposed in a second plane parallel to the first plane, the first and second planes spaced apart to form a first antenna cavity between the ground plane and the main patch, the main patch having a second aperture, wherein the patch antenna has a first desired operating frequency within a millimeter wave frequency range over which wireless communications is supported and the first desired operating frequency is a function of a length of the second aperture, the length of the second aperture being set to achieve the first desired operating frequency of the patch antenna; and a parasitic patch disposed in a third plane parallel to the first and second planes, the third plane spaced apart from the second plane to form a second antenna cavity between the main patch and the parasitic patch on a side of the main patch opposite the first antenna cavity, the parasitic patch adding a second desired operating frequency within the millimeter wave frequency range to the patch antenna over which wireless communications is supported, the second desired operating frequency higher than the first desired operating frequency; and wherein the length of the second aperture is further set to achieve the second desired operating frequency of the patch antenna by establishing a hybrid mode where both the main patch and the parasitic patch radiate at the second desired operating frequency.

2. The patch antenna of claim 1, wherein the first antenna cavity is an air gap.

3. The patch antenna of claim 1, wherein geometric centers of the apertures are coaxially aligned.

4. The patch antenna of claim 1, wherein the ground plane is disposed on a first substrate and the main patch is disposed on a second substrate.

5. The patch antenna of claim 4, wherein the first and second substrates are layers of a multilayer printed circuit board.

6. The patch antenna of claim 5, wherein the first antenna cavity is formed by removing a portion of the multilayer printed circuit board.

7. The patch antenna of claim 1, wherein the first desired operating frequency of the patch antenna is at about 28 GHz and the second desired operating frequency is at about 39 GHz.

8. The patch antenna of claim 1, wherein the geometric centers of the main patch and the parasitic patch are coaxially aligned.

9. The patch antenna of claim 8, wherein the geometric centers of the main patch, the parasitic patch and the apertures are coaxially aligned.

10. The patch antenna of claim 1, wherein:

the apertures have lengths of about 2.7 mm;

a height of the first antenna cavity is about 0.3 mm;

a height of the second antenna cavity is about 0.1 mm;

a length of the main patch is about 3.4 mm to about 3.6 mm;

a width of the main patch is about 3.4 mm to about 3.6 mm; and a length of the parasitic patch is about 0.6 mm to about 0.9 mm.

11. An electronic device, comprising:

the patch antenna of claim 1; and communication circuitry operatively coupled to the patch antenna, wherein the communication circuitry is configured to generate the radio frequency signal that is feed to the patch antenna for emission as part of wireless communication with another device.

12. The patch antenna of claim 10, wherein the first aperture is linear and the second aperture is linear and parallel to the first aperture.

13. The patch antenna of claim 1, wherein the first aperture is linear and the second aperture is linear and parallel to the first aperture.

14. The patch antenna of claim 1, wherein the first antenna cavity extends an entire distance from the ground plane to the main patch.

15. The patch antenna of claim 1, wherein the second aperture consists of a single slot in the main patch.

16. The patch antenna of claim 15, wherein the geometric centers of the first aperture in the ground plane and the second aperture in the main patch are coaxially aligned.

17. The patch antenna of claim 16, wherein the first aperture is linear and the second aperture is linear and parallel to the first aperture.

18. The patch antenna of claim 1, wherein first desired operating frequency and a bandwidth of the patch antenna decrease with increases in physical length of the second aperture.

* * * * *